US009107018B2

(12) United States Patent
Lamb et al.

(10) Patent No.: US 9,107,018 B2
(45) Date of Patent: Aug. 11, 2015

(54) SYSTEM AND METHOD FOR SOUND REPRODUCTION

(75) Inventors: William John Lamb, Eindhoven (NL); Werner Paulus Josephus De Bruijn, Eindhoven (NL); Armin Gerhard Kohlrausch, Eindhoven (NL); Thomas Pieter Jan Peeters, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 258 days.

(21) Appl. No.: 13/811,350

(22) PCT Filed: Jul. 11, 2011

(86) PCT No.: PCT/IB2011/053072

§ 371 (c)(1), (2), (4) Date: Jan. 21, 2013

(87) PCT Pub. No.: WO2012/011015

PCT Pub. Date: Jan. 26, 2012

(65) Prior Publication Data

US 2013/0121516 A1 May 16, 2013

(30) Foreign Application Priority Data

Jul. 22, 2010 (EP) ..... 10170382

(51) Int. Cl.

| | |
|---|---|
| ***H04R 5/02*** | (2006.01) |
| ***H04S 3/00*** | (2006.01) |
| ***H04S 7/00*** | (2006.01) |
| *H04R 5/00* | (2006.01) |
| *H04S 1/00* | (2006.01) |

(52) U.S. Cl.

CPC . *H04S 3/00* (2013.01); *H04S 7/302* (2013.01); *H04S 1/00* (2013.01); *H04S 2420/01* (2013.01)

(58) Field of Classification Search

CPC ... H04S 2400/01; H04S 2420/01; H04S 3/00; H04R 5/00; H04R 5/02; H04R 5/027

USPC ..... 381/307, 300, 1, 56, 17, 19

See application file for complete search history.

(56) References Cited

U.S. PATENT DOCUMENTS

| | | | | |
|---|---|---|---|---|
| 7,197,151 | B1 * | 3/2007 | Sibbald et al. | 381/310 |
| 7,613,305 | B2 * | 11/2009 | Vieilledent et al. | 381/17 |
| 2004/0057587 | A1 | 3/2004 | Thiel | |
| 2004/0252849 | A1 | 12/2004 | Johnston et al. | |
| 2005/0169459 | A1 * | 8/2005 | Marton et al. | 379/406.15 |
| 2007/0076894 | A1 * | 4/2007 | Inoue et al. | 381/27 |
| 2007/0253576 | A1 | 11/2007 | Bai et al. | |

FOREIGN PATENT DOCUMENTS

| | | | |
|---|---|---|---|
| EP | 1761110 | A1 | 7/2007 |
| GB | 2369976 | A | 6/2002 |
| GB | 2443291 | A | 4/2008 |

* cited by examiner

*Primary Examiner* — Vivian Chin
*Assistant Examiner* — Ammar Hamid

(57) ABSTRACT

A sound reproduction system for reproducing an audio signal as originating from a first direction relative to a nominal position (211) and orientation of a listener is provided. The system comprises a first sound transducer arrangement (105) arranged to generate sound reaching the nominal position (211) from a first position corresponding to the first direction; and a second sound transducer arrangement (107) arranged to generate sound reaching the nominal position (211) from a second position corresponding to a different direction than the first direction. The arrangements may specifically be loudspeakers positioned at the given positions. A drive circuit (103) generates a first drive signal for the first sound transducer arrangement (105) and a second drive signal for the second sound transducer arrangement (107) from the audio signal. The first position and the second position are located on a sound cone of confusion for the nominal position (211) and the nominal direction. A more flexible loudspeaker positioning may be achieved.

15 Claims, 6 Drawing Sheets

SYSTEM AND METHOD FOR SOUND REPRODUCTION

FIELD OF THE INVENTION

The invention relates to a system and method for sound reproduction and in particular, but not exclusively, to a surround sound reproduction system, e.g. for home cinema applications.

BACKGROUND OF THE INVENTION

Spatial sound systems providing an enhanced spatial experience over traditional stereo or mono systems have become very popular. For example, surround systems with five or seven spatial channels (often in addition to one or two Low Frequency Effect (LFE) channels) have become very popular for applications such as Home Cinema systems.

In many situations it is desirable to have small form factor loudspeakers. However, the small size invariably affects the amplitude and low frequency response of the sound reproduction. As such there is typically a trade-off between the audio quality and the physical form factor for the loudspeakers. In addition, spatial sound systems often exacerbate the issues as they not only tend to use a larger number of loudspeakers but also restrict the degree of freedom in the placement of these as the sound source position is of importance for the spatial perception.

For example, surround sound systems such as Home Cinema systems make use of multiple loudspeakers to create an immersive sound experience similar to that of a full size cinema. For the most convincing and immersive sound experience all the loudspeakers must be capable of full range audio reproduction. Furthermore, the loudspeakers must be positioned at appropriate positions to provide the desired spatial experience. This requires large loudspeakers which are often unsightly and difficult to position in a room. Many consumers find the additional loudspeakers provide too much clutter. It is therefore desirable to reduce the size of some or all of the loudspeakers such that they are less visible and can be more easily incorporated into a room. In particular, the rear loudspeakers are often considered to be inconvenient in terms of size and positions. However, as the dimensions of the loudspeakers are reduced, so too is the low-frequency performance and the maximum Sound Pressure Level (SPL) achievable at a given frequency.

To address such issues most home cinema systems employ a satellite subwoofer arrangement, where the satellites are approximately full range sound reproducers, and the subwoofer reinforces only the lowest frequencies. Satellite subwoofer arrangements typically require the crossover frequency from subwoofer to satellite loudspeakers to be as low as possible. In a room environment localization of low-frequency (<120 Hz) sound sources is difficult. This enables almost free placement of the subwoofer within the room. If the crossover frequency is too high (above 120 Hz), the localization cues relating to the subwoofer become apparent making the low-frequency source easy to locate. For good sound quality and proper stereophonic imaging effects, the satellites must therefore be capable of almost full range sound reproduction. If the satellites are not capable of covering the full audio range from 120 Hz to 20 kHz the system is compromised. The designer can chose either to leave a gap in the frequency response of the system from 120 Hz to the low-frequency cut off of the satellite loudspeakers, or increase the crossover frequency to the subwoofer. Both of these compromises reduce the audio quality and immersive listening experience.

Thus, in many scenarios trade-offs between size and positioning of loudspeakers on one hand and audio quality and spatial experience on the other hand tend to be suboptimal.

Hence, an improved sound reproduction system would be advantageous and in particular a system allowing for increased flexibility, increased freedom in positioning loudspeakers, improved audio quality, increased sound pressure levels, an improved spatial experience and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided sound reproduction system for reproducing an audio signal as originating from a first direction relative to a nominal position and a nominal orientation of a listener, the sound reproduction system comprising: a first sound transducer arrangement arranged to generate sound reaching the nominal position from a first position corresponding to the first direction; a second sound transducer arrangement arranged to generate sound reaching the nominal position from a second position corresponding to a different direction than the first direction; a drive circuit for generating a first drive signal for the first sound transducer arrangement and a second drive signal for the second sound transducer arrangement from the audio signal; wherein the first position and the second position are located on a sound cone of confusion for the nominal position and the nominal direction.

The invention may in many embodiments provide improved sound quality and a desired spatial sound source perception while providing additional flexibility in location of sound transducers. In particular, it may allow a plurality of sound transducers to combine with one sound transducer dominating the spatial perception while the other sound source(s) located at a different position significantly improve the audio quality without significantly affecting the spatial perception.

The spatial perception of a listener at the nominal position and oriented in the nominal direction can be dominated by the sound from the first sound transducer arrangement while the sound from the second transducer arrangement may dominate or significantly impact the audio quality perceived by the listener.

The invention may in many embodiments allow an improved trade-off between two or more of audio quality, sound pressure levels, spatial perception, sound transducer arrangement form factor and positioning.

The approach may be applied in many different applications including for example sound reproduction for flat screen displays, such as flat screen televisions or monitors, computer multimedia loudspeakers, automotive audio systems, or Home Cinema applications.

A sound cone of confusion is a cone in three dimensional space in which Inter-aural Time Differences (ITD) and Inter-aural Level Differences (ILD) are sufficiently close to not provide significantly different spatial cues to a user located at the origin of the cone. The sound cone of confusion represents a relative arrangement of the listening position (and orientation), the first position and the second position which results in the ITD and ILD values for the first and second position being substantially the same at the listening position (and orientation). Thus, the sound cone of confusion for a specific arrangement may be defined for a given first position and listening position and orientation or equivalently for a given second position and listening position and orientation.

The sound cone of confusion may originate from the nominal position and comprise all spatial coordinates for which the ITD is less than 10% of the average sound path delay from the position to the nominal position, and the ILD is less than 10% of the average level at the nominal position. Specifically, the sound cone of confusion may be a set of positions for which an audio path delay varies by no more than 50 μsec and a path loss varies by no more than 1 dB. In many embodiments, the sound cone of confusion may extend up to 5°, or in some cases even 10°, from an ideal cone for which the ILD and ITD are identical.

The sound reproduction may for example be a surround sound system and the audio signal may be a spatial channel of a surround sound signal, such as a front left or right channel signal, or a surround or rear left or right channel signal.

In accordance with an optional feature of the invention, the drive circuit is arranged to generate the first drive signal to correspond to higher frequency range of the audio signal than the second drive signal.

This may provide particularly advantageous performance in many embodiments. In particular, it may often provide an advantageous arrangement where spatial perception is dominated by the first transducer arrangement, which can be very small, while allowing audio quality of lower and mid frequency ranges to be dominated by the second transducer arrangement, which may have a larger form factor than the first transducer arrangement, and which may be more flexibly positioned. Indeed, the spatial position may be determined by the first transducer arrangement thereby allowing much more flexibility in positioning the possibly larger second transducer arrangement more discretely. Indeed, the approach may in many embodiments create an illusion of full range sound originating from a small loudspeaker, which on its own is incapable of radiating low frequencies.

In accordance with an optional feature of the invention, at least one of the first sound transducer arrangement and the second sound transducer arrangement comprises a loudspeaker positioned at the first position and the second position respectively.

This may allow a practical and low complexity implementation.

In accordance with an optional feature of the invention, the sound reproduction system further comprises a third sound transducer arrangement arranged to generate sound reaching the nominal position from a third position corresponding to a different direction than the first direction; and wherein the drive circuit is arranged to further generate a third drive signal for the third sound transducer arrangement from the audio signal.

This may provide improved sound quality in many embodiments, and may provide a high degree of flexibility in the trade-off between sound transducer positions, audio quality and spatial experience.

In accordance with an optional feature of the invention, the sound reproduction system is arranged to reproduce a further audio signal as originating from a second direction relative to the nominal position and the nominal orientation, and the sound reproduction system further comprises: a third sound transducer arrangement arranged to generate sound reaching the nominal position from a third position corresponding to the second direction; and wherein the drive circuit is arranged to generate the second drive signal by combining at least some signal components of the first audio signal and the second audio signal, and to generate a third drive signal for the third sound transducer from the second audio signal.

This may provide a particularly efficient and high performance approach for providing multiple spatial sound source positions. Indeed, the second sound transducer arrangement may be reused for different positions with each position requiring only one additional transducer arrangement, which typically may be a small higher frequency range loudspeaker with the lower frequency ranges being provided by a single shared larger loudspeaker located at a convenient position. The first and second audio signals may e.g. be different audio signals of a surround sound signal, such as a left front and rear sound signal, or a right front and rear sound signal.

In accordance with an optional feature of the invention, the drive circuit is arranged to generate the first drive signal and the second drive signal such that sound from the second transducer arrangement reaches the nominal position with a delay of between 1 msec and 50 msec relative to sound from the first transducer arrangement.

This may provide an increased dominance of the first transducer arrangement for providing the spatial cues to the listener. The relative delays between the sound from the two sound transducer arrangements may be determined relative to the audio signal. For example, it may be determined as the timing difference at the nominal position of signal components that are simultaneous in the audio signal. The approach may use the precedence effect to further emphasize the spatial cues from the first sound transducer arrangement relative to spatial cues from the second sound transducer arrangement.

In accordance with an optional feature of the invention, the drive circuit is arranged to adjust at least one of a level difference and a timing difference between the first drive signal and the second drive signal to compensate for a distance difference between an audio path from the first sound transducer arrangement to the nominal position and an audio path from the second sound transducer arrangement to the nominal position.

This may provide improved performance and/or increased flexibility in positioning of the sound transducer arrangements. For example, interworking loudspeakers may be located at different distances to the listening position without the varying distance resulting in unacceptable degradations.

In accordance with an optional feature of the invention, the sound reproduction system further comprises an adjuster arranged to receive an input signal from a microphone positioned at the nominal position and to adjust the at least one of the timing difference and the level difference in response to the microphone signal.

This may provide a particularly advantageous adaptation resulting in improved performance in many scenarios.

In accordance with an optional feature of the invention, the audio signal is a spatial channel of a surround sound signal, and the drive circuit is further arranged to generate the second drive signal in response to a second spatial channel of the surround sound signal.

This may provide a particularly efficient surround sound reproduction. The approach may allow a possibly larger loudspeaker arrangement for providing audio quality at lower to midrange frequencies to be combined with small higher frequency loudspeakers that provide the dominant spatial cues. The audio signal may for example be a left or right rear/surround channel with the second spatial channel being the corresponding front channel. Thus, the same second sound transducer arrangement may be shared for a front and rear/surround channel thereby reducing the number of separate sound transducers needed.

In accordance with an optional feature of the invention, the first sound transducer arrangement is arranged to radiate a directional sound reaching the nominal position from the first direction via at least one reflection.

This may provide a particularly advantageous setup in many embodiments. In particular, it may provide additional flexibility in the positioning of the first sound transducer arrangement relative to the desired perceived sound source position. In many embodiments it may allow both the first and second sound transducer arrangements to be positioned to the front of the user while providing a perception of sound originating to the side or rear of the user.

In some embodiments, the first and second position has a horizontal difference of no more than 50 cm.

In accordance with an optional feature of the invention, the first sound transducer arrangement is arranged to generate a virtual sound source at the first position; and the second sound transducer arrangement comprises a loudspeaker positioned at the second position.

This may provide a particularly advantageous implementation in many embodiments. In particular, it may provide additional flexibility in the positioning of the first sound transducer arrangement relative to the desired perceived sound source position.

In accordance with an optional feature of the invention, the second sound transducer arrangement is arranged to generate a virtual sound source at the second position; and the first sound transducer arrangement comprises a loudspeaker positioned at the first position.

This may provide a particularly advantageous implementation in many embodiments. In particular, it may provide additional flexibility in the positioning of the second sound transducer arrangement relative to the desired perceived sound source position.

In accordance with an optional feature of the invention, the second position is such that an angle between a direction corresponding to the second position and the first direction is no less than 20°, or indeed in some cases advantageously no less than 30° or even 45°.

In some embodiments, the distance between the first position and the second position is no less than 1 meter, or in some cases even 2 or 3 meters.

The approach may allow for very significant differences in the position of the different sound transducer arrangements. Indeed, the approach may allow two loudspeakers to be located far from each other yet combining to provide high audio quality and a perceived single sound source position. An increased flexibility in the positioning of sound sources may be achieved and the approach may allow at least the second sound transducer arrangement to be located discretely at some distance from the desired spatial sound source direction perceived by a listener at the nominal position.

According to an aspect of the invention there is provided a method of reproducing an audio signal as originating from a first direction relative to a nominal position and a nominal orientation of a listener, the method comprising: generating a first drive signal for a first sound transducer arrangement and a second drive signal for a second sound transducer arrangement from the audio signal; the first sound transducer arrangement generating sound reaching the nominal position from a first position corresponding to the first direction; the second sound transducer arrangement generating sound reaching the nominal position from a second position corresponding to a different direction than the first direction; and wherein the first position and the second position are located on a sound cone of confusion for the nominal position and the nominal direction.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a surround sound reproduction system and in particular to a sound reproduction system for a home cinema application. However, it will be appreciated that the invention is not limited to this application but may be applied to many other sound reproduction systems and in many other usage scenarios.

Figure 1:
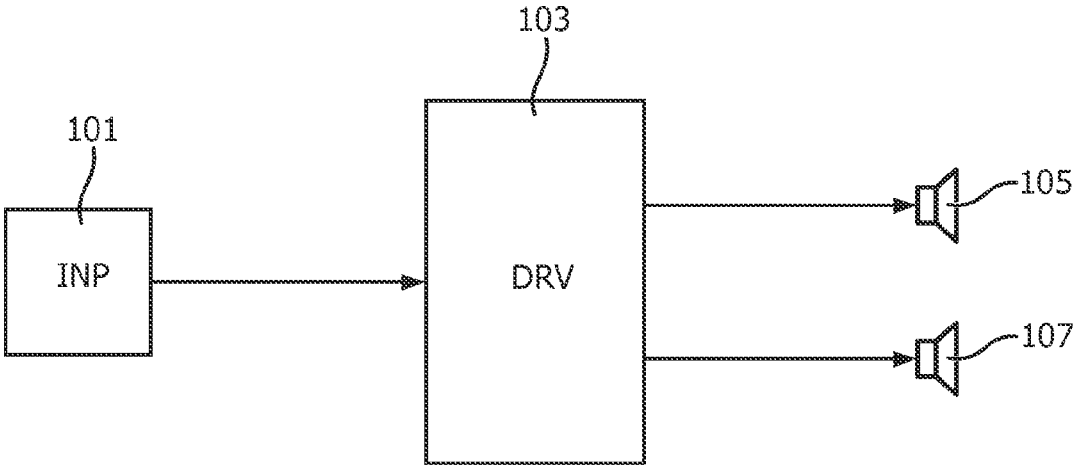
FIG. 1 illustrates an example of elements of a sound reproduction system in accordance with some embodiments of the invention.

FIG. 1 illustrates an example of elements of a sound reproduction system in accordance with some embodiments of the invention. FIG. 1 specifically illustrates elements associated with the reproduction of a single mono audio signal which for example may be a single spatial channel of a surround sound system. Thus, the sound reproduction system may further include other functionality for reproduction of other channels of the surround sound system and specifically for reproducing other spatial channels. It will also be appreciated that the functionality of FIG. 1 may as appropriate also be used for reproduction of sound for other channels.

The system of FIG. 1 comprises an input circuit 101 which receives an audio signal. The audio signal may for example be a surround sound audio signal which e.g. may comprise five or seven spatial channels together with possibly one or two shared Low Frequency Effects (LFE) channels. The input circuit 101 may receive the input audio signal from any suitable internal or external source.

The input circuit 101 is coupled to a drive circuit 103 which in the example is a single channel drive circuit. Thus, the input circuit 101 provides an audio signal from one of the spatial surround sound channels to the drive circuit 103. For example, the elements of FIG. 1 may be arranged to reproduce, say, a surround (rear or side) left channel of the surround sound signal.

The sound is reproduced by first and second sound transducers which in the specific example are conventional loudspeakers 105, 107. The drive circuit 103 is arranged to generate a first drive signal for the first loudspeaker 105 and a second drive signal for the second loudspeaker from the audio signal. Thus, in the specific example the left rear sound is reproduced by the combination of the two loudspeakers 105, 107. In order to provide the appropriate spatial experience, it is important that the reproduced sound is perceived to originate from a suitable direction at a given listening position.

Figure 2:
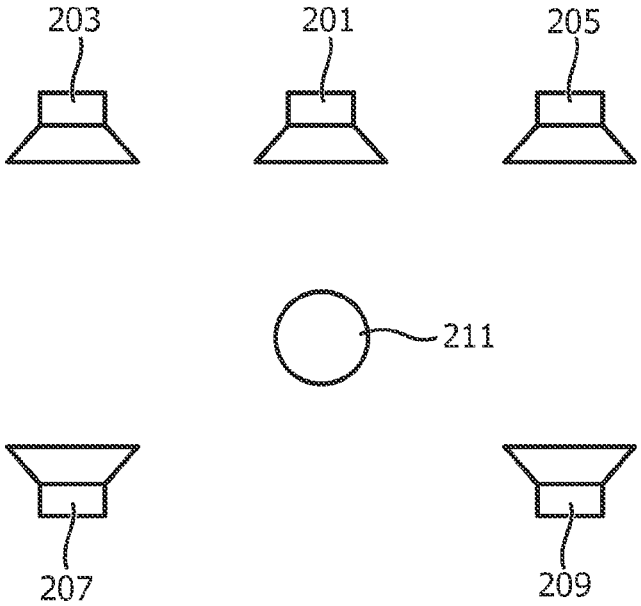
FIG. 2 illustrates an example of a sound source setup for a surround sound home cinema system.

FIG. 2 illustrates an example of a typical system setup for a five channel surround sound spatial sound reproduction system, such as a home cinema system. The system comprises a centre sound source 201 providing a centre front channel, a left front sound source 203 providing a left front channel, a right front sound source 205 providing a right front channel, a left rear sound source 207 providing a left rear channel, and a right rear sound source 209 providing a right rear channel. The five sound sources 201-209 together provide a spatial sound experience at a listening position 211 and allow a listener at this location to experience a surrounding and immersive sound experience. Thus, typical surround sound systems are set up to provide an appropriate spatial experience for a listener positioned at a nominal or reference position and having a nominal or reference orientation, i.e. in the setup of FIG. 2 the listener is assumed to be facing the center front channel sound source 201.

It will be appreciated that the nominal (or reference) position and orientation is not dependent on any actual listener being present or on listeners being present at other positions. Rather the nominal position and orientation are a feature of the system/set up. The nominal position and orientation may specifically represent the position and orientation for which the spatial experience has been optimized.

The requirement for loudspeakers to be located in particular to the side or behind the listening position is typically considered disadvantageous as it not only requires additional loudspeakers to be located at inconvenient positions but also require these to be connected to the driving source, such as typically a home cinema power amplifier. In a typical system setup, wires are required to be run from the surround sound sources to an amplifier unit that is typically located proximal to the front sound sources. Furthermore, in order to achieve a desired audio quality a reasonably large form factor is typically required of all loudspeakers functioning as sound sources. In order to alleviate or mitigate the perceived disadvantages, it is desirable to have as much freedom as possible in positioning the loudspeakers that provide the sound reproduction. However, this desire is typically opposed by the requirement that a specific spatial experience must be provided at the nominal position.

In the approach of FIG. 1 increased flexibility in the positioning of the loudspeakers 105, 107 is achieved by allowing the two loudspeakers 105, 107 to be positioned apart while ensuring that the spatial perception predominantly being generated by the first loudspeaker 105. Specifically, the first loudspeaker 105 is positioned such that the sound therefrom reaches the nominal position from a desired direction associated with the spatial channel. Specifically, the first loudspeaker 105 is positioned such that the sound from it reaches the nominal listening position from a direction corresponding to a desired position for the left surround sound source.

The second loudspeaker 107 is positioned at a different position and is not restricted to a position where the sound reaches the nominal position from the direction of the desired spatial sound source position. Rather, the approach allows the second loudspeaker 107 to be positioned with more freedom. This may be particularly advantageous e.g. if the second loudspeaker is substantially larger than the first loudspeaker 105, since it may allow the second loudspeaker 107 to be positioned more discretely.

However, none of the first and second loudspeakers 105, 107 are positioned completely freely but rather are restricted to positions that relative to each other fall on a sound cone of confusion for the nominal position and the nominal direction.

Figure 3:
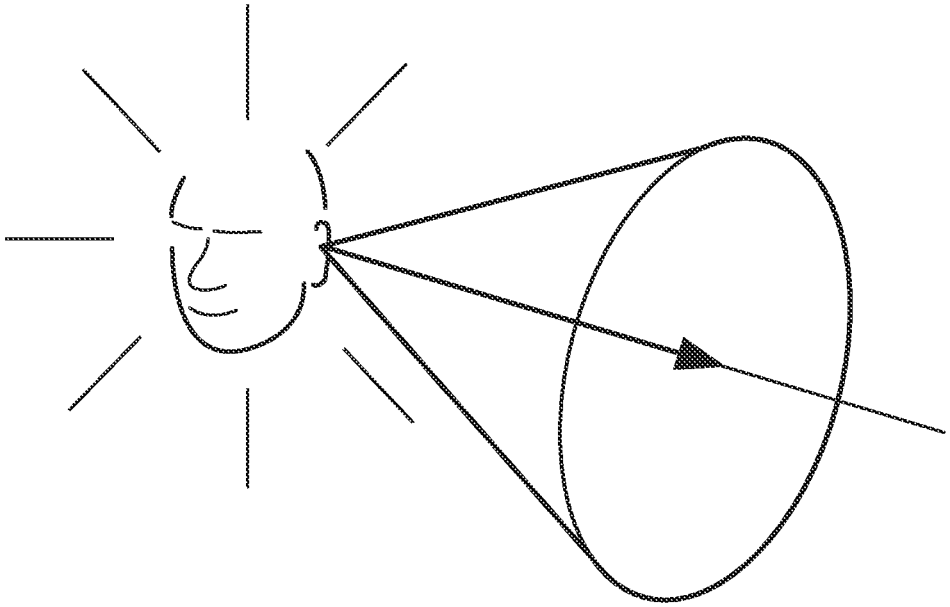
FIG. 3 illustrates an example of a sound cone of confusion for a listener.

The human auditory system makes use of Inter-aural Time Differences (ITD), Inter-aural Level Differences (ILD) and spectral cues to locate sound sources. Spectral cues are generally manifest at high frequencies where the shape of the outer ear begins to influence the scattering of the sound. At lower frequencies, typically below 3 kHz, the ITDs and ILDs are the main localization modalities. The ITD and ILD are the result of the different acoustical paths taken by a sound to arrive at either ear. At low frequencies (20 to 500 Hz) the intensity of the sound is approximately equal in both ears and the ITD is the dominant localization modality. The ITD is the difference in arrival times of a sound source at each ear typically due to the path length difference. As the frequency increases the head begins to act as an acoustic shadow and the intensity of the sound at different parts of the head is dependent on the source location. This acoustic shading effect gives rise to intensity differences at the ears. Sound sources located at different relative positions to the head result in a combination of angle dependant ITD and ILD cues. Due to the approximate symmetry of the head, for most source directions, the ITD and ILD of the sound source are not unique to that specific angular elevation and azimuth. Without additional spectral information, it is difficult for the listener to distinguish whether the source is coming from one or another location with the same ITD and ILD. The locus of points for which a sound source possesses the same ITD and ILD is known as the cone of confusion, as illustrated by the example of FIG. 3.

The sound cone of confusion thus represents a relative arrangement of the listening position (and orientation), and sound source positions which result in the ITD and ILD values for the first and second position being substantially the same for a nominal user at the listening position (and orientation). It will be appreciated that the cone of confusion is not just defined by the listening position (and orientation) but by the listening position (and orientation) and at least one point on the cone of confusion. Thus, the cone of confusion defines a relative set of positions for sound sources such that if one sound source position is determined (together with the listening position and orientation), the corresponding sound cone of confusion for which the ITD and ILD values are substantially the same is also defined.

In many cases the cone of confusion can be a hindrance, especially with headphone listening, where the problem of front back reversal is well known. However, in the system of FIG. 1, the phenomenon is actively used to position two interacting loudspeakers at different positions while still allowing them to be perceived as originating from a single desired sound source position. Thus, the system of FIG. 1 may exploit the cone of confusion to create strong and robust auditory illusions.

Indeed, since the auditory system finds it difficult to interpret the location of a sound source on the cone of confusion, this effect is actively exploited to mask the location of a loudspeaker. For example, if a low-frequency loudspeaker is positioned at one location and a second high frequency loudspeaker (tweeter) is positioned at another position on the cone of confusion created by the position of the low-frequency speaker and the listening position and orientation, an illusion can be created that full range sound comes entirely from the tweeter.

Specifically, the tweeter can reproduce high-frequency content which is then filtered on its acoustic path by the listener's head and outer ear. This gives a spectral signature unique to the location of the tweeter, making the tweeter easy to locate. At low frequencies the ITD and ILDs are consistent with any position on the cone of confusion. The location of the low-frequency loudspeaker does not impart significant spectral shaping to the low-frequency signal, and is therefore difficult to locate precisely on the cone of confusion. The lack of a uniquely identifiable location of the lower frequency loudspeaker allows the auditory system to fuse the two sound sources, creating one full range auditory image at the location of the tweeter. This auditory illusion is very strong as the localization cues are entirely consistent with the target sound source location (the location of the tweeter).

Thus, the sound cone of confusion in such an example may be given by the position of the low-frequency speaker and the listening position and orientation, thereby defining a set of appropriate positions for the high-frequency speaker. Equivalently, the sound cone of confusion may be given by the position of the high-frequency speaker and the listening position and orientation, thereby defining a set of appropriate positions for the low-frequency speaker.

The sound cone of confusion may thus be considered to correspond to those relative positions in space for which the inter-time difference and level difference between a (nominal) listener's ears are sufficiently low to not provide substantially different spatial cues at the listening position. Specifically, the sound cone of confusion may typically correspond to the spatial positions for which the ITD varies no more than 50 micro sec and the ILD no more than 2 dB. Thus, the sound cone of confusion may specifically in some embodiments define a set of positions for which an audio path delay varies by no more than 50 micro sec and a path loss difference varies by no more than 1 dB. In some embodiments, the cone of confusion may comprise the spatial positions for which the ITD is less than 10% of the average sound path delay from the positions to the nominal listening position and for which the ILD is less than 10% of the average level at the nominal position.

Such requirements will result in the ILD and ITD characteristics being perceived to correspond to the same position. In that case, the spatial position of the combined sound source will be perceived to correspond to the position indicated by the frequency modification of the high frequency sound by the human ear. Thus, the spatial position will be perceived to be that of the tweeter.

Figure 4:
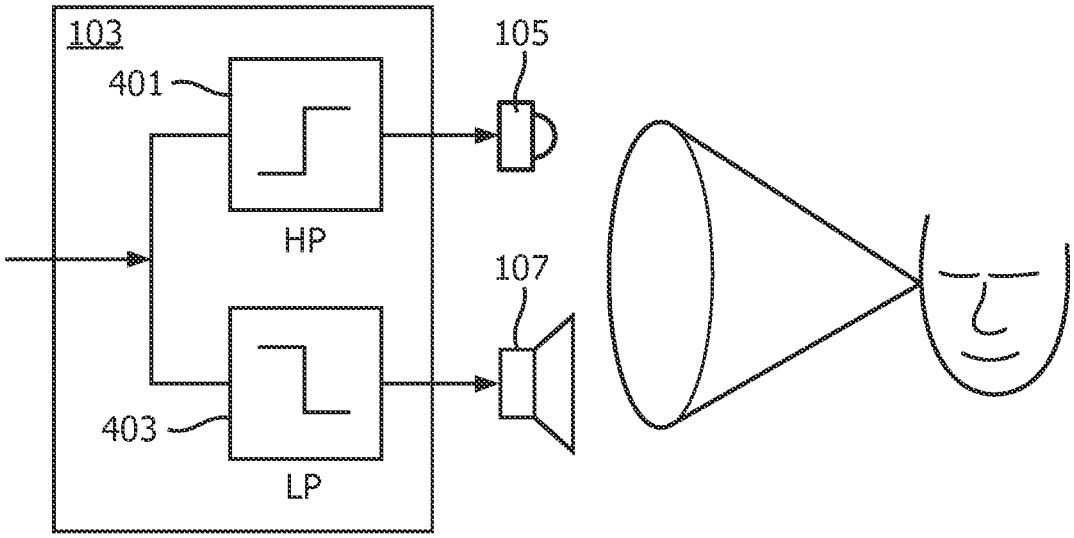
FIG. 4 illustrates an example of elements of a sound reproduction system in accordance with some embodiments of the invention.

In the example, the first loudspeaker 105 is a high frequency loudspeaker, such as a tweeter, and the second loudspeaker 107 is a low frequency loudspeaker. Accordingly, the generation of the first drive signal for the first loudspeaker 105 by the drive circuit 103 typically includes a high pass filtering of the input audio signal and the generation of the second drive signal for the second loudspeaker 107 by the drive circuit 103 typically includes a low pass filtering of the input audio signal. As illustrated in FIG. 4 the drive circuit 103 may specifically comprise a high pass filter and a low pass filter (along with e.g. suitable amplification functionality which for clarity and brevity is not explicitly discussed herein).

Thus, in the example, the drive circuit 103 generates the first drive signal to correspond to a higher frequency range of the audio signal than the second drive signal. In some embodiments, the two loudspeakers 105, 107 may each cover a separate part of the spectrum and indeed may together cover the whole audio band. In other embodiments, other loudspeakers may e.g. cover other frequency intervals of the audio signal. For example, a subwoofer may support frequencies up to, say, 120 Hz, the second loudspeaker 107 may cover a frequency interval from, say, 120 Hz to 500 Hz, a third loudspeaker may cover a frequency interval from, say, 500 Hz to 1.5 kHz and the first loudspeaker 105 may cover the frequency interval from, say, 1.5 kHz up to e.g. 20 kHz.

In many embodiments, a lower 3-dB cut-off frequency of the first drive signal may advantageously be no less than 400 Hz, 600 Hz, 800 Hz, 1 kHz or even 2 kHz. The higher the selected frequency, the smaller and more discrete the first loudspeaker 105 may be.

In many embodiments, an upper 3-dB cut-off frequency of the second drive signal may advantageously be no less than 400 Hz, 600 Hz, 800 Hz, 1 kHz or even 2 kHz. The higher the selected frequency, the more of the frequency interval is covered by the second loudspeaker and consequently the smaller and more discrete the first loudspeaker 105 may be.

The lower 3-dB cut-off frequency of the first drive signal and the upper 3-dB cut-off frequency of the second drive signal may differ substantially from each other, and may e.g. differ by no less than 200 Hz, 400 Hz, 600 Hz, 800 Hz, or even 1 kHz.

In some embodiments, a cross-over frequency between the first and second drive signals may be in the interval from 200 Hz to 2 kHz, and often advantageously in the interval from 600 Hz to 1.5 kHz. The cross-over frequency may be determined as the frequency for which the attenuation of the two drive signals relative to the input audio signal is the same.

Such cross-over and cut-off frequencies may in particular allow small form factor high frequency drivers to provide the dominant spatial cues. In particular, a suitable selection of frequency ranges for the different loudspeakers may ensure that the spatial cues provided from the second loudspeaker 107 are restricted to ITD and ILD cues. Accordingly, the design may ensure that the second loudspeaker 107 provides only spatial cues that are also consistent with spatial cues for the position of the first loudspeaker 105.

Indeed, in many conventional satellite-subwoofer arrangements, the crossover frequency is chosen to suit the frequency response of the loudspeakers. In the described approach the strength of the effect at the listening position is independent of the crossover frequency as long as this frequency remains below a threshold value. This threshold value is a function of the Head Related Transfer Function (HRTF), and is the point at which spectral modification of the acoustic path due to scattering from the outer ears begins to contribute significant localization cues. The threshold value for an individual listener is a function of their anatomy and is variable over a population of users. However, a nominal threshold value can be selected which covers almost the entire population. Crossover frequencies as high as 800 Hz have been demonstrated to perform exceedingly well, and indeed higher crossover frequencies are possible in many embodiments.

In the example, physical first and second loudspeakers 105, 107 are positioned directly on the cone of confusion with the first loudspeaker 105 being positioned at a desired position for the spatial sound source perception. For the left surround channel the first loudspeaker 105 may for example be positioned on the sound cone of confusion to the left rear of the listener. The second loudspeaker 107 may be positioned at a significant distance and in a significantly different direction than the first loudspeaker 105. For example, the second loudspeaker 107 may be positioned to the front of the listening position. This may in many embodiments be particularly advantageous because the second loudspeaker 107 e.g. may be positioned proximal to the surround sound loudspeakers for other channels and specifically close to loudspeakers for rendering the front side channels. However, the second loudspeaker 107 is positioned such that it is on the same sound cone of confusion as the first loudspeaker 105. As a consequence, the reproduced sound from both loudspeakers 105, 107 will be perceived to arrive at the listening position from the first loudspeaker 105, i.e. from the rear left direction.

The first and second loudspeakers 105, 107 may be positioned at positions that are at a distance to each other of no less than 1 meter, 2 meters or even 3 meters. The loudspeakers 105, 107 may be positioned in completely different directions relative to the nominal listening position. In some embodiments the direction to the two loudspeakers may vary by no less than 20° and indeed in some embodiments by no less than 30, 45°, or even 60°.

The described approach thus uses a processing and loudspeaker layout scheme which permits the reduction in size of e.g. rear surround loudspeakers to the extreme without degrading the subjective audio quality and spatial performance at the listening position. Such size reductions permit the cost and power consumption of the loudspeaker unit to be significantly lowered. Reducing the size of the rear loudspeakers is very desirable for lifestyle ranges of home cinema systems. Reducing power consumption is an enabling step towards battery powered wireless operation of the surround sound loudspeakers.

The reduction in size is achieved through the use of psycho acoustically driven signal processing and multiple loudspeaker units judiciously positioned relative to the listening position to ensure localization cues consistent with the target source location.

The approach provides a very robust method with which to create a psychoacoustic illusion. This type of auditory illusion is further independent of the high-frequency acoustic transfer function of the individual listener. This allows the illusion to be effective for almost all users with normal hearing.

An added advantage of the processing is the simplicity of the filtering operations necessary, which can be performed either on digital or analogue circuitry.

This illusion is also not restricted to sound sources in the horizontal plane. The high frequency sources, or indeed low frequency sources, can also be placed above or below the listener. The illusion of full range audio at the location of the high frequency source will be robust so long as the low frequency source lies on the same cone of confusion.

However, although it is not necessary that the sound sources reside in the horizontal plane it may in some embodiments be advantageous that they do not deviate significantly therefrom. In many embodiments at least the vertical difference between the first and second sound transducer position on the cone of confusion may be no more than 50 cm, or even 25 cm. This may have advantages in terms of the sweet spot size. Indeed, if both loudspeakers are located in the horizontal plane and equidistant from the listener, the effect can be shown to be robust for all displacements along the inter-aural axis.

In the example of FIG. 1, two loudspeakers 105, 107 were used to render the input audio signal to the drive circuit 103. However, in other embodiments more than two loudspeakers may be used. For example, rather than a single low/mid-range loudspeaker covering e.g. the frequency range up to, say, 1 kHz, this frequency range may be covered by a low range loudspeaker and a mid-range loudspeaker. In such a case, the extra loudspeaker(s) need not be collocated with any other loudspeakers but may e.g. be positioned at other positions. As long as these positions are on the cone of confusion (and covers frequency ranges below the direction dependent filtering of the ear), the additional loudspeaker will not provide new spatial cues to the user and the total reproduced sound will be perceived to originate from a single source.

In the example of FIG. 1, the audio signal being rendered by the loudspeakers 105, 107 is a spatial channel of a surround sound signal. Specifically, the spatial channel may be the left surround channel. In some embodiments, the second loudspeaker 107 may be used to render two (or more) of the spatial channels. For example, the second loudspeaker 107 may be located to the front left of the listening position and thus at a position where it is suitable for rendering the front left spatial channel.

Figure 5:
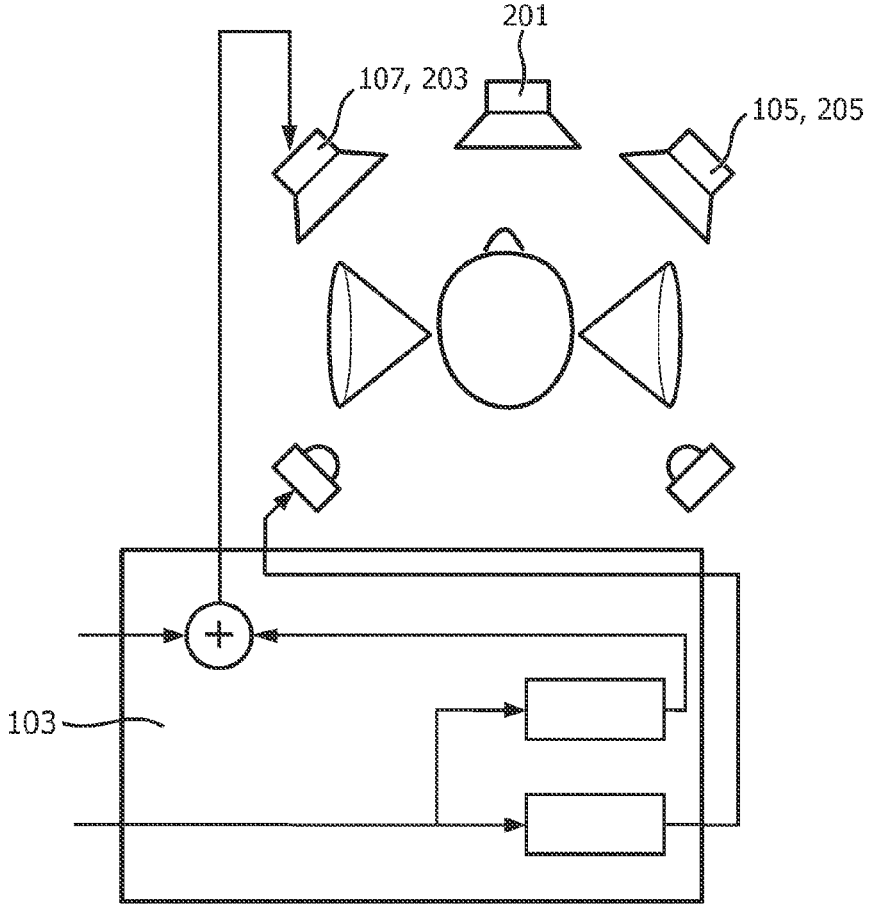
FIG. 5 illustrates an example of elements of a sound reproduction system in accordance with some embodiments of the invention.

FIG. 5 illustrates an example of such an embodiment. In the example, the second loudspeaker 107 is also used as the front left loudspeaker 203. In the example, this is achieved by the drive circuit 103 comprising a combiner which combines the left front channel audio signal with the low pass filtered audio signal for the left surround channel. Thus, the second drive signal is generated from audio signals of both spatial channels. The drive circuit 103 may specifically generate the second drive signal as a weighted summation of the audio signals of the two channels (typically following filtering of at least one of the audio signals).

The approach may of course be used similarly for e.g. the rear surround channel. As a specific example, FIG. 5 illustrates a surround sound system wherein two full range loudspeakers reproduce the front left and right channels. Two high-frequency transducers are placed to the rear of the listener at angles mirroring the angular locations of the full range loudspeakers, placing them on the same cone of confusion as the front loudspeakers. The surround left and right channels are split into a low-frequency portion and a high-frequency portion. The high frequencies are reproduced by the high-frequency loudspeakers, while the low-frequency portion is added to the full range channels in front of the listener. The effect is to produce a very striking impression of a full range sound coming from the rear high-frequency loudspeakers. This system enables very compact rear surround sound loudspeakers. Given that the high-frequency loudspeakers draw very little power they could be battery powered and receive music signals from the surround sound receiver wirelessly. Furthermore, the front two full range loudspeakers double in rendering both the front side channels and the lower frequency part of the surround channels. Thus, the system can even make use of loudspeaker types that are already employed in home cinema systems for the front channels without further modification.

It will be appreciated that the approach is in no way limited to creating the illusion of rear channels. For example, the system can be reversed such that the full range loudspeaker is to the rear of the listener and the high-frequency source is placed in front of the user. This is of particular use for devices which, due to form factor restrictions, do not allow integration of full range loudspeakers, while full range sound localization at the location of the device is desirable. Examples include flat panel televisions and computer monitors.

In some embodiments, the loudspeakers 105, 107 rendering the audio signal may be positioned at varying distances from the listening position but still on the cone of confusion. Indeed, it should be noted that the cone of confusion represents a three dimensional object/surface and not just a ring. Indeed, the loudspeakers are not required to be located equidistantly from the listener. If the loudspeakers are located at varying distances from the listening position, delay compensation may be applied to ensure a constant arrival time of all sound components at the listener's position.

Figure 6:
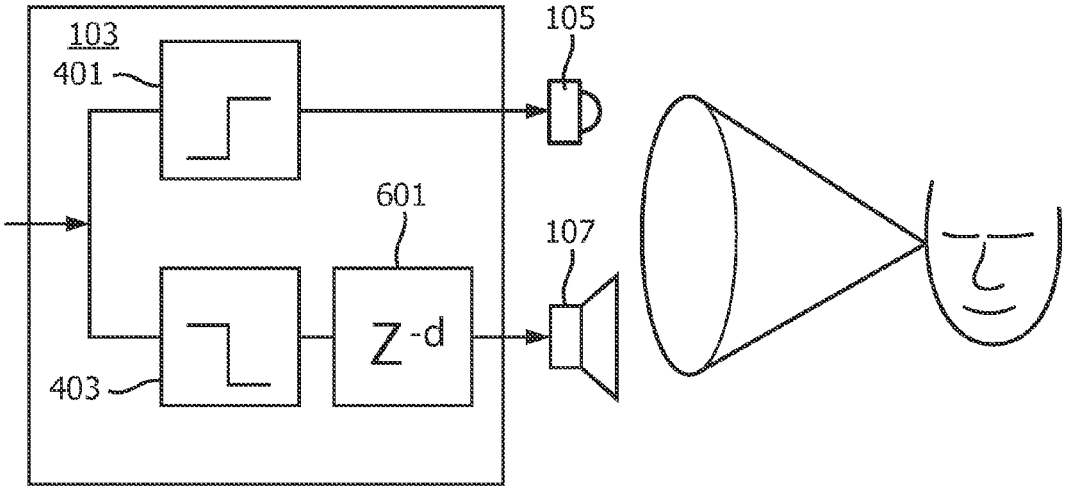
FIG. 6 illustrates an example of elements of a sound reproduction system in accordance with some embodiments of the invention.

Specifically, the drive circuit 103 may comprise functionality for adjusting the level difference and/or the timing difference between the first drive signal and the second drive signal. For example, FIG. 6 illustrates how the drive circuit 103 may include a delay 601 which increases the delay between the second drive signal and the input audio signal relative to the delay between the first drive signal and the input audio signal. The delay is set to compensate for an increased distance to the first loudspeaker 105 from the listening position than for the second loudspeaker 107 to the listening position. Thus, the delay compensates for the difference in the propagation delays of the audio paths from the first and second loudspeaker 105, 107 respectively to the nominal listening position.

Thus, in such systems the inter-aural time difference and/or the inter-aural level difference providing the spatial cues are managed by the positioning of the loudspeakers 105, 107 on the sound cone of confusion whereas the absolute (or average) timing difference or level difference between the speakers 105, 107 (rather than between the ears of a user) are controlled by processing of the drive signals.

The adjustment of either the inter-speaker timing difference or level difference (or both) may in some embodiments be automatically adapted to the specific characteristics of the setup. For example, a microphone located at the listening position can be used to record the acoustic output of the multichannel system and to calculate the relative distances to the loudspeakers. This distance can be converted into a sample based delay line and used to compensate the emission times of the respective low and high-frequency signals to ensure consistency of the localization cues. The microphone can also be used to adjust properties of the audio system such as the frequency response and amplitude of the individual sound sources to optimize the listening experience.

In some embodiments, the drive circuit may be arranged to generate the first drive signal and the second drive signal such that sound from the second loudspeaker 107 reaches the nominal position with a delay of between 1 msec and 50 msec relative to sound from the first loudspeaker 105. Thus, simultaneous audio components of the input audio signal will result in sound at the listening position which is delayed from the second loudspeaker 107 relative to the first loudspeaker.

Such an approach may exploit the psycho acoustic phenomenon known as the so-called "precedence effect" (also referred to as the "Haas effect" or the "law of the first wavefront"). This phenomenon indicates that when the same sound signal is received from two sources at different positions and with a sufficiently small delay, the sound is perceived to come only from the direction of the sound source that is ahead, i.e. from the first arriving signal. Thus, the psychoacoustic phenomenon refers to the fact that the human brain derives most spatial cues from the first received signal components. Indeed, it has been found that such an effect is even achieved when applied to different frequency intervals of an audio signal.

Through the use of the precedence effect it is possible to create auditory illusions that improve the perceived audio quality and bandwidth of satellite loudspeakers with a restricted bandwidth. The precedence effect is a psycho acoustic phenomenon based on temporal weighting in the auditory system. For localization purposes the auditory system weights the first sound to arrive at the ears with the most importance. If two loudspeakers placed at different locations emit the same signal, the loudspeaker whose signal arrives at the listener's ears first will be perceived as the sole origin of the sound source. This is valid under the conditions that the delay between the sounds arriving at the ears is above 1 ms and below a threshold value of 5-50 ms, depending on the type of stimulus. As mentioned, the precedence effect has also been shown to be partly effective when sound sources are split into different frequency bands and reproduced by different loudspeakers.

The precedence effect may thus be used to further improve the spatial perception of a single source positioned at the position of the first loudspeaker 105. Indeed, whereas only relying on the precedence effect may be suboptimal in many scenarios (e.g. the illusion is not completely effective and may result in distorted stereophonic imaging), the combination of the precedence effect and the utilization of the cone of confusion provides a substantially improved illusion.

Thus, the precedence effect may be used to further increase the robustness of the illusion e.g. with respect to small movements and rotations of the listeners head. This is achieved by adding a delay to the low-frequency channel. The delay is chosen such that the low-frequency information from the low-frequency channel arrives at the listening position approximately 1 to $\tau$ ms after the high-frequency information. The delay time $\tau$ may range from 5 to 50 ms depending on the audio signal, and may be chosen through an optimization based on the given system, crossover frequencies, acoustic environment and input signal.

The approach may for example be implemented by the system of FIG. 6 determining a suitable delay required for the propagation time difference to be compensated and then setting the delay 601 to e.g. 10 msec more than the calculated value.

Figure 7:
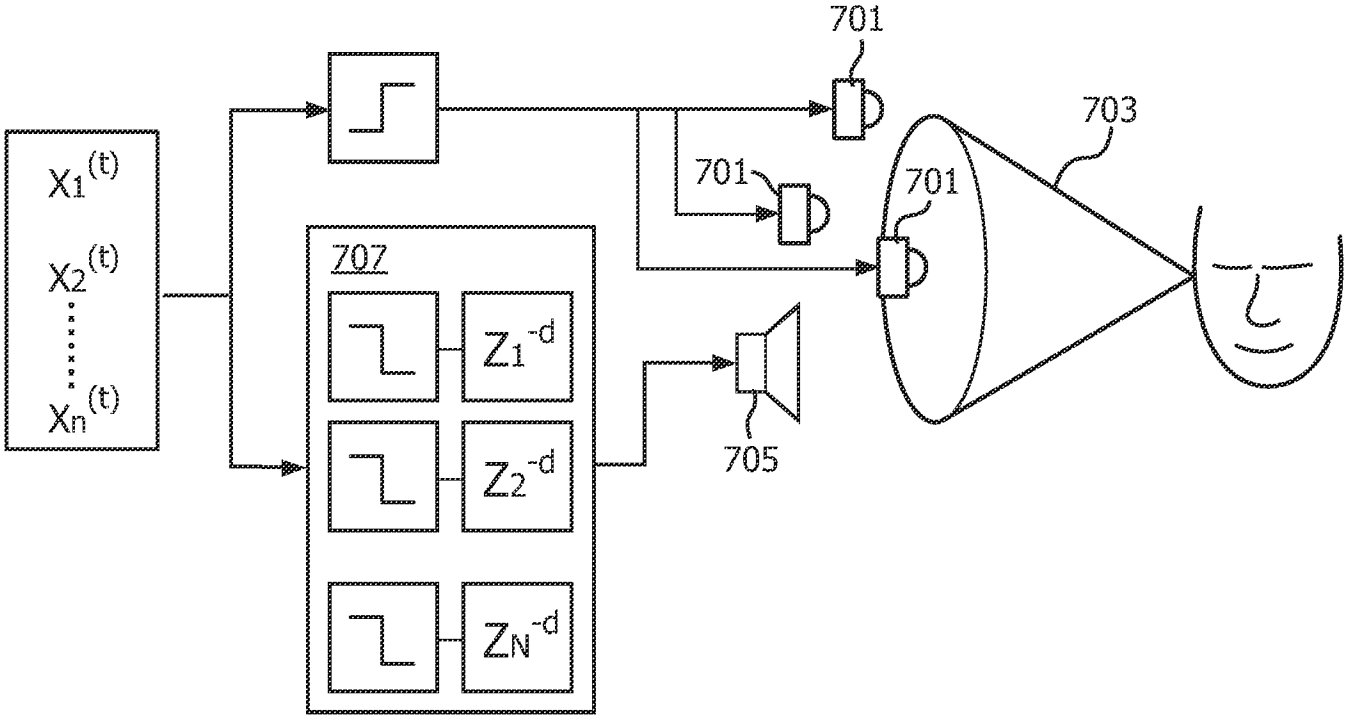
FIG. 7 illustrates an example of elements of a sound reproduction system in accordance with some embodiments of the invention.

In some embodiments, the approach may be used to provide an illusion of full range sources at multiple locations. This may specifically be achieved using a single low-frequency transducer and a plurality of high-frequency units. An example of such an approach is shown in FIG. 7. In the example, each channel of an N channel multichannel signal ($X_1(t)$, $X_2(t)$, $X_3(t)$, . . . $X_n(t)$) is split into the two frequency regions using a cross-over network. Each of the resulting high-frequency signals are sent directly to the N high-frequency loudspeakers 701 located on the cone of confusion 703. The low-frequency signals of each channel are summed and transmitted to the low-frequency loudspeaker 705 also located on the cone of confusion. In the example, a set of delays 707 is included to provide path length difference compensation and/or precedence effect enhancement for each channel.

Thus, in the example of FIG. 7, the system is arranged to reproduce at least one additional sound signal reaching the nominal listening position from a different direction than for the first audio loudspeaker. This is achieved by including a further loudspeaker positioned in the different direction and generating a drive signal for this audio loudspeaker from the additional audio signal. Furthermore, the second drive signal for the second loudspeaker 705 is generated by combining the two audio signals. The combination may specifically be a weighted summation where the weighting may reflect the relative desired volume for the two signals.

In the previous examples, the sound was provided by physical loudspeakers positioned directly on the appropriate positions of the sound cone. However, in other embodiments the sound may not be provided by physical loudspeakers at such positions but may rather be provided by virtual sound sources on the cone of confusion. Thus, rather than using physical loudspeakers on the cone of confusion, the approach may use sound transducer arrangements that can provide a virtual sound source positioned on the cone of confusion. Sound transducer arrangements may for example be a physical loudspeaker but may e.g. alternatively or additionally be a transducer array, a directional loudspeaker, a modulated ultrasound transducer etc.

As an example, a conventional full range loudspeaker positioned on the cone of confusion may be used as the second loudspeaker 107 whereas the first loudspeaker 105 is replaced by a sound transducer arrangement which is arranged to radiate a directional sound to reach the nominal position from the first direction via at least one reflection. Thus, in the example, the high frequency source is created using a directional beam of sound which upon reflection from e.g. a wall will be scattered into the room. In this case a listener would perceive the reflection point on the wall to be the origin of the sound source. Therefore, the sound transducer arrangement may be arranged to radiate a highly directional sound beam such that it hits the wall at a point that is in the cone of confusion for the nominal listening position and orientation. Such an audio radiation may e.g. be realized by a large array of high frequency units and beam forming, combined with a suitable audio beam forming algorithm.

As another example the beam may be generated using an ultrasonic or parametric loudspeaker to radiate a modulated ultrasonic signal in the direction towards the reflection point on the wall. This may project a highly directional beam of high intensity ultrasound modulated by the high frequency audio. As the ultrasound propagates through the air, the audio signal is demodulated by non-linearities to form a highly directional beam of sound. When this sound beam encounters an obstacle, such as a wall or large object, the audio frequency sound is reflected over a broad range of angles thus providing the perception of a sound source located at the incidence point.

It will be appreciated that in some embodiments, it may be advantageous for the high frequency transducer to be a virtual sound source whereas the low frequency transducer is a physical loudspeaker located on the cone of confusion. For example, when generating a rear channel using the described approach, this may allow all sound transducers to be positioned in front of the user while still providing a spatial perception of sound reaching the listener from behind. Thus, in some embodiments, the physical high-frequency loudspeakers of the original example may be replaced by virtual sound sources. A principle advantage of this approach is that the rear loudspeakers no longer need to be physically present.

In other embodiments, the second loudspeaker 107 may be replaced by a virtual sound source while the first loudspeaker 105 possibly may be maintained as a physical loudspeaker positioned on the cone of confusion. Thus, in some embodiment, the low-frequency loudspeaker(s) may be replaced by virtual sources e.g. using techniques such as crosstalk cancelling or a stereo dipole approach. A principle advantage of this approach is that virtual low-frequency sources can relatively easily be created at any angular location in the frontal plane and therefore the restrictions on locating the high-frequency transducers may be relaxed as the low frequency virtual sound source can relatively easily be positioned wherever the cone of confusion for the specific high frequency transducer position ends up being. In other words; given the arbitrary location of a high frequency transducer, a complimentary virtual low frequency source can be synthesized at the appropriate position given by the sound cone of confusion that arises from the selected location. The location of the loudspeakers and listener is preferably known before the virtual sources are located on the appropriate cone of confusion. Methods of determining the relative locations of the loudspeakers are well known and it will be appreciated that any suitable method for doing so may be used.

It will be appreciated that different techniques and algorithms exist for generating virtual sound sources (which may be considered to be a sound source that is not physically present at the location the listener perceives it to be). The creation of virtual sources is achieved by producing an audio signal at the ears of the listener with either exact or approximate localization cues corresponding to the target location.

In the following, a specific example of how virtual sound sources can be generated will be described.

Figure 8:
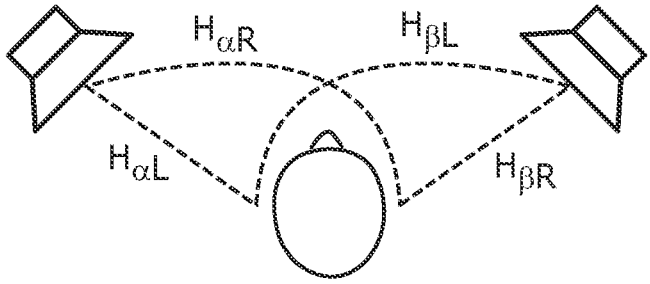
FIG. 8 illustrates an example of a loudspeaker setup.

The acoustic paths taken by a sound transmitted from a pair of loudspeakers to reach the ears are presented schematically in FIG. 8. The acoustic paths create spectral filtering and ITD and ILDs specific to the loudspeakers' locations making the loudspeakers easily localizable by the listener. Each acoustic path can be represented as a transfer function $H_{\alpha L}$, where the first subscript refers to the angular location of the loudspeaker and the second subscript to the ear. The ear signals can be expressed mathematically using the matrix equation $$\begin{bmatrix} e_L \\ e_R \end{bmatrix} = M \begin{bmatrix} L \\ R \end{bmatrix} = \begin{bmatrix} H_{\alpha L} & H_{\beta L} \\ H_{\alpha R} & H_{\beta R} \end{bmatrix} \begin{bmatrix} L \\ R \end{bmatrix}.$$

Based on this equation it is clear that applying an inverse matrix operation $M^{-1}$ to the signals before transmission by the loudspeakers it is possible to eliminate the effects of crosstalk $$\begin{bmatrix} e_L \\ e_R \end{bmatrix} = MM^{-1} \begin{bmatrix} L \\ R \end{bmatrix} = \begin{bmatrix} L \\ R \end{bmatrix}.$$

Figure 9:
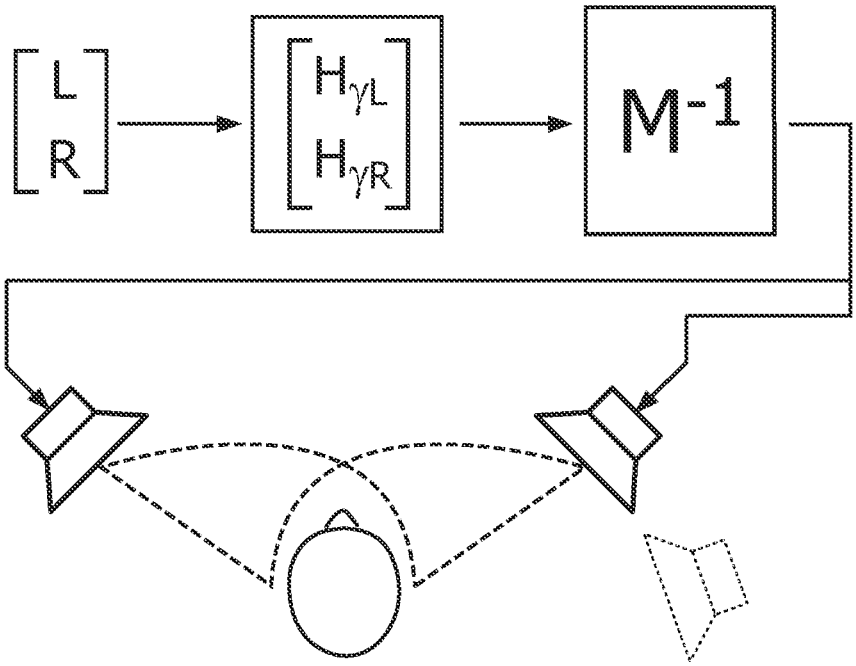
FIG. 9 illustrates an example of elements of a system for generating a virtual sound source.

Under this paradigm the left ear receives signals only from the left loudspeaker, and the right ear receives signals only from the right loudspeaker. By embedding localization cues into the loudspeaker signals L and R, using either modeled or measured transfer functions $H_{\gamma L}$ and $H_{\gamma R}$, it is possible to create virtual sound sources at any location γ around the listeners head as illustrated in FIG. 9:

$$\begin{bmatrix} e_L \\ e_R \end{bmatrix} = \begin{bmatrix} H_{\gamma L} \cdot L \\ H_{\gamma R} \cdot R \end{bmatrix}$$

It is often desirable to bring the physical loudspeakers close together. This makes the transfer matrix M less complex enabling a more optimal inversion. Indeed if the loudspeakers are very close together, stereo dipole techniques can be used to approximate the transfer matrix and its inversion, allowing very simple filtering operations. An advantage of this approach is less coloration and a fairly robust auditory illusion. Approximate processing schemes such as the stereo dipole approach typically restrict the virtual sources to the frontal plane.

Under ideal conditions crosstalk cancelling results in perfect perception of virtual sources since the auditory cues are entirely consistent with the intended target source location. Due to imperfections in the transfer function measurements, clipping during the matrix inversion, dynamic range loss and power limitations of the amplifier and loudspeakers, the strength of the illusions can be reduced, or rendered ineffective. For example the transfer matrix M may often be ill suited to inversion being 'ill conditioned'. This implies that small perturbations in the measured or modeled transfer function can result in large errors in the inverted transfer matrix $M^{-1}$. The ill conditioning makes crosstalk cancelling unstable to small head movements, especially at low frequencies. Another by-product of this ill conditioned system is significant coloration of the audio. This is particularly apparent for listeners not positioned precisely in the sweet spot.

The illusion is dependent on the accuracy of the transfer matrix M. The matrix is constructed of the modeled or measured transfer functions depicted in FIG. 8. These transfer functions are not only a function of the loudspeakers location, but also of the anatomy of the user and are unique to each individual. As small imperfections in the transfer functions can create large errors in the crosstalk filters, ideally accurate filters for each individual would be measured and used for the cancellation network. For economic viability a generic set of transfer functions can be chosen to provide a good match for the majority of the population, even if not ideal for many users.

The crosstalk path is removed by transmitting additional sound to cancel the unwanted acoustic information. This additional sound can be considered 'wasted' energy as it does not contribute to the audio heard by the listener. In some cases the audio signal at the ears is 30 dB lower than the transmitted audio signal. The effect of this 'wasted' power is to reduce the dynamic range of the system and place high demands on the loudspeakers and amplifiers.

Virtual source generation can be complicated and it can be difficult to obtain robust and convincing results. Using the cone of confusion concept in tandem with virtual loudspeaker technology, physical loudspeakers can reinforce the necessary localization cues over certain frequency bands, significantly strengthening the auditory illusions and or improving energy efficiency. These two modalities are in fact highly complementary; the cone of confusion concept allows very convincing auditory illusions to be created while crosstalk cancelling and virtual source generation relaxes the otherwise strict cone of confusion geometric requirements.

As mentioned previously, this complementary nature may be exploited to replace either the low or high frequency loudspeakers by virtual sound sources.

Figure 10:
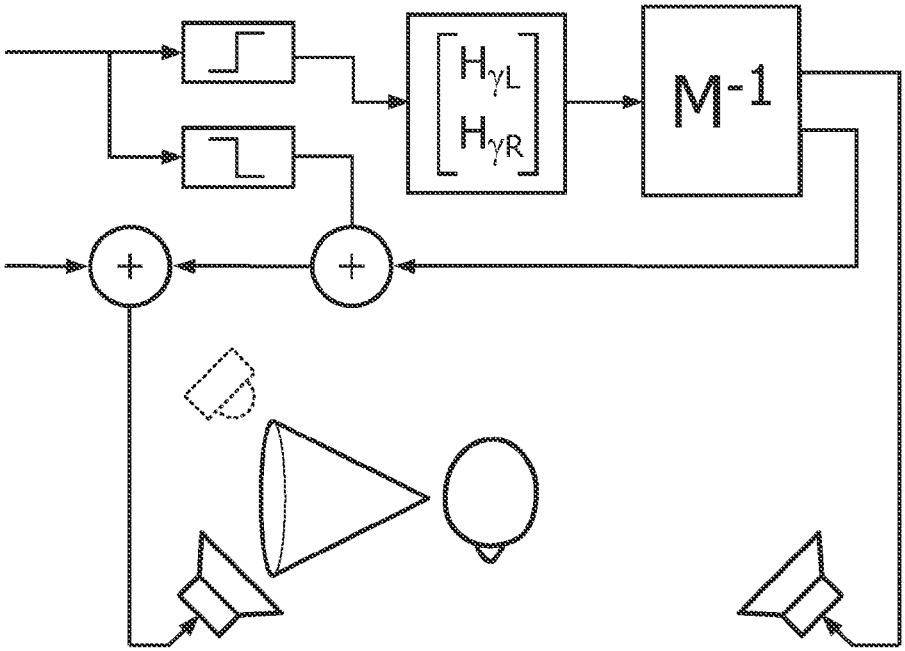
FIG. 10 illustrates an example of elements of a sound reproduction system in accordance with some embodiments of the invention.

FIG. 10 illustrates an example wherein the physical high-frequency sources for the rear loudspeakers are replaced by virtual sources. The most obvious advantage of this approach is that the user no longer needs to position additional loudspeakers to the rear. The illusion is dependent on proper crosstalk cancelling at high frequencies. The system will only be effective if each virtual source is properly located on the same cone of confusion as the physical low-frequency loudspeaker, which limits the range of available virtual source positions.

Compared to a full range cross talk cancelling system, this approach represents a significant saving in electrical power by elimination of the low-frequency crosstalk cancelling. This represents a potential saving of up to 30 dB of loudspeaker and amplifier headroom in the low-frequency reproduction, allowing the use of much cheaper drive units and amplifiers.

Figure 11:
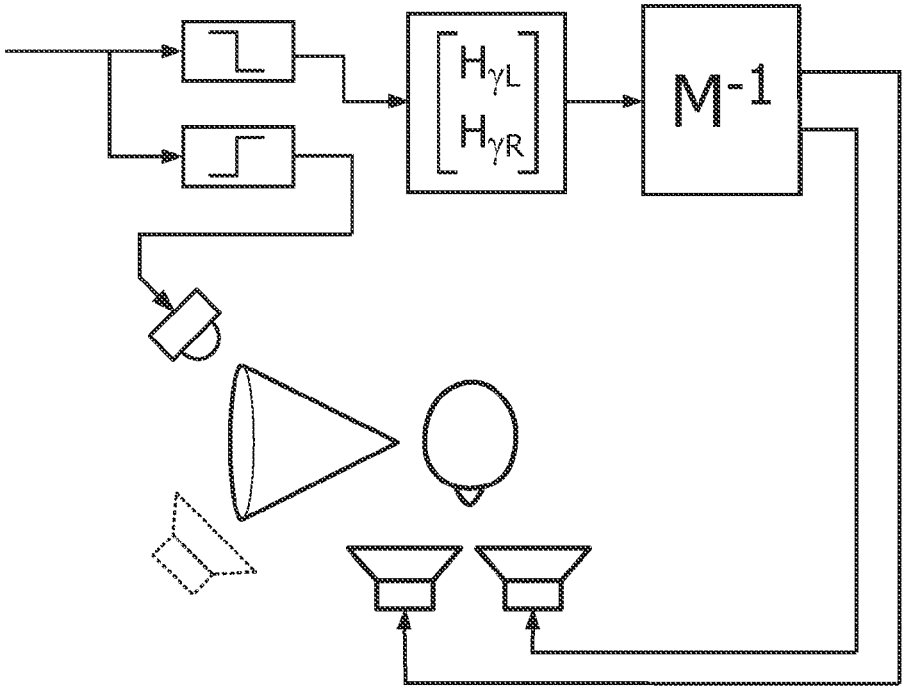
FIG. 11 illustrates an example of elements of a sound reproduction system in accordance with some embodiments of the invention.

FIG. 11 illustrates an example wherein the physical low-frequency loudspeakers of the rear channels are replaced with virtual sources. The most significant advantage of this approach is that the high-frequency sources may be placed arbitrarily around the listener. Use of low-frequency virtual sources relaxes all constraints on loudspeaker positioning for the cone of confusion setup since complimentary low-frequency sources can be generated for any necessary angle.

All the necessary low-frequency virtual sources can be created by one compact cabinet containing at least two low-frequency transducers. Greater efficiency and control over the virtual sources may be achieved by increasing the number of low-frequency loudspeakers. These transducers must be capable of enough acoustic output to provide sufficient crosstalk cancelling. The low-frequency virtual sources can be created using very simple stereo dipole processing as the low-frequency sources only need to be generated in the frontal plane. As long as the ITD and ILD cues of the low-frequency sources are consistent with the high-frequency units the illusion will be very robust.

Because the high-frequency cues are provided by real sources, they are not affected by the differences in individual anatomical features. This is a significant advantage over standard crosstalk cancelling schemes, which to be truly effective need individualized crosstalk filters. At low frequencies, below the crossover frequency (e.g. 800 Hz), the anatomical spectral filtering provides less significant auditory cues meaning that person specific filters are not necessary for this approach.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A sound reproduction system for reproducing an audio signal as originating from a first direction relative to a nominal position and a nominal orientation of a listener, the sound reproduction system comprising:

a first sound transducer arrangement arranged to generate sound reaching the nominal position from a first position corresponding to the first direction;

a second sound transducer arrangement arranged to generate sound reaching the nominal position from a second position corresponding to a different direction than the first direction; and a drive circuit for generating a first drive signal for the first sound transducer arrangement and a second drive signal for the second sound transducer arrangement from the audio signal, wherein the first position and the second position are located on a same sound cone of confusion for the nominal position and the nominal direction.

2. The sound reproduction system as claimed in claim 1, wherein the drive circuit is arranged to generate the first drive signal to correspond to a higher frequency range of the audio signal than the second drive signal.

3. The sound reproduction system as claimed in claim 1, wherein at least one of the first sound transducer arrangement and the second sound transducer arrangement comprises a loudspeaker positioned at the first position and the second position, respectively.

4. The sound reproduction system as claimed in claim 1, wherein said sound reproduction system further comprises a third sound transducer arrangement arranged to generate sound reaching the nominal position from a third position on the cone of confusion corresponding to a different direction than the first direction, and wherein the drive circuit is arranged to further generate a third drive signal for the third sound transducer arrangement from the audio signal.

5. The sound reproduction system as claimed in claim 1, wherein said sound reproduction system is further arranged to reproduce a further audio signal originating from a second direction relative to the nominal position and the nominal orientation, wherein the sound reproduction system further comprises:

a third sound transducer arrangement arranged to generate sound reaching the nominal position from a third position corresponding to the second direction;

and wherein the drive circuit is arranged to generate the second drive signal by combining at least some signal components of the first audio signal and the further audio signal, and to generate a third drive signal for the third sound transducer from the further audio signal.

6. The sound reproduction system as claimed in claim 1, wherein the drive circuit is arranged to generate the first drive signal and the second drive signal such that sound from the second transducer arrangement reaches the nominal position with a delay of between 1 msec and 50 msec relative to sound from the first transducer arrangement.

7. The sound reproduction system as claimed in claim 1, wherein the drive circuit is arranged to adjust at least one of a level difference and a timing difference between the first drive signal and the second drive signal to compensate for a distance difference between an audio path from the first sound transducer arrangement to the nominal position and an audio path from the second sound transducer arrangement to the nominal position.

8. The sound reproduction system as claimed in claim 7, wherein said sound reproduction system further comprises an adjuster arranged to receive an input signal from a microphone positioned at the nominal position and to adjust the at least one of the timing difference and the level difference in response to the microphone signal.

9. The sound reproduction system as claimed in claim 1, wherein the audio signal is a spatial channel of a surround sound signal, and the drive circuit further arranged to generate the second drive signal in response to a second spatial channel of the surround sound signal.

10. The sound reproduction system as claimed in claim 1, wherein the first sound transducer arrangement is arranged to radiate a directional sound reaching the nominal position from the first direction via at least one reflection.

11. The sound reproduction system as claimed in claim 1, wherein the first sound transducer arrangement is arranged to generate a virtual sound source at the first position, and the second sound transducer arrangement comprises a loudspeaker positioned at the second position.

12. The sound reproduction system as claimed in claim 1, wherein the second sound transducer arrangement is arranged to generate a virtual sound source at the second position, and the first sound transducer arrangement comprises a loudspeaker positioned at the first position.

13. The sound reproduction system as claimed in claim 1, wherein the second position is such that an angle between a direction corresponding to the second position and the first direction is no less than 20°.

14. The sound reproduction system as claimed in claim 1, wherein the sound cone of confusion defines a set of positions for which an audio path delay varies by no more than 50 micro sec and a path loss varies by no more than 1 dB.

15. A method of reproducing an audio signal as originating from a first direction relative to a nominal position and a nominal orientation of a listener, the method comprising: generating a first drive signal for a first sound transducer arrangement and a second drive signal for a second sound transducer arrangement from the audio signal; the first sound transducer arrangement generating sound reaching the nominal position from a first position corresponding to the first direction; the second sound transducer arrangement generating sound reaching the nominal position from a second position corresponding to a different direction than the first direction; and wherein the first position and the second position are located on a same sound cone of confusion for the nominal position and the nominal direction.

* * * * *